US009608349B2

(12) United States Patent
Mashiyama et al.

(10) Patent No.: US 9,608,349 B2
(45) Date of Patent: Mar. 28, 2017

(54) CONTACT HAVING TWO CONTACT PORTIONS WITH THEIR CENTRAL LINES IN ONE PLANE

(71) Applicant: DDK LTD., Tokyo (JP)

(72) Inventors: Jinichi Mashiyama, Tokyo (JP); Takanobu Yoshimi, Tokyo (JP); Yukio Saito, Tokyo (JP); Kei Ishikawa, Tokyo (JP)

(73) Assignee: DDK LTD., Tokyo (JP)

( * ) Notice: Subject to any disclaimer, the term of this patent is extended or adjusted under 35 U.S.C. 154(b) by 0 days.

(21) Appl. No.: 14/801,495

(22) Filed: Jul. 16, 2015

(65) Prior Publication Data

US 2016/0043494 A1 Feb. 11, 2016

(30) Foreign Application Priority Data

Aug. 6, 2014 (JP) ..... 2014-160213
Dec. 4, 2014 (JP) ..... 2014-245440
Mar. 6, 2015 (JP) ..... 2015-044202

(51) Int. Cl.
*H01R 4/48* (2006.01)
*H01R 12/71* (2011.01)
(Continued)

(52) U.S. Cl.
CPC ..... *H01R 12/716* (2013.01); *H01R 4/48* (2013.01); *H01R 13/2457* (2013.01); *H01R 13/2492* (2013.01); *H01R 13/41* (2013.01)

(58) Field of Classification Search
CPC .. H01R 13/26; H01R 123/02; H01R 23/7073; H01R 23/725; H01R 4/48;
(Continued)

(56) References Cited

U.S. PATENT DOCUMENTS 3,631,381 A * 12/1971 Pittman ..... H01R 12/721 439/637
5,605,464 A * 2/1997 Ikesugi ..... G01R 1/0408 439/68
(Continued)

FOREIGN PATENT DOCUMENTS

JP 3117439 B1 12/2000
JP 2001-23711 A 1/2001
(Continued)

OTHER PUBLICATIONS

Korean Office Action for Korean Application No. 10-2015-0109910, mailed Sep. 27, 2016, with English translation.

*Primary Examiner* — Chandrika Prasad
(74) *Attorney, Agent, or Firm* — Birch, Stewart, Kolasch & Birch, LLP

(57) ABSTRACT

A contact configured to be retained and arranged in an insulating object includes a contact portion that is configured to come into contact with a counterpart object, a connecting portion connectable to an object to be connected, a main body portion having two side walls and a joining wall that joins the side walls, the main body portion having a substantially U-shaped cross section, first and second contact pieces protruding from the two side walls and extending along a direction of mating with a counterpart object, and first and second contact portions disposed at free end parts of the first and second contact pieces, respectively. The first and second contact portions each has a curved shape and configured to come into contact with the same surface of the counterpart object. The first and second contact portions are spaced apart along the direction of mating, the first and second contact portions being configured to come into roll-face contact with the counterpart object.

4 Claims, 9 Drawing Sheets

(51) Int. Cl.
*H01R 13/24* (2006.01)
*H01R 13/41* (2006.01)

(58) Field of Classification Search
CPC ..... H01R 12/16; H01R 12/18; H01R 13/17; H01R 13/187
USPC ..... 439/638, 660, 862
See application file for complete search history.

(56) References Cited

U.S. PATENT DOCUMENTS 5,634,819 A * 6/1997 Pan ..... H01R 12/721 439/637
6,634,911 B1 * 10/2003 Billman ..... H01R 9/091 439/637
7,429,196 B2 * 9/2008 Takei ..... H01R 27/02 439/541.5
7,637,783 B2 * 12/2009 Sasaoka ..... H01R 43/16 439/637
8,480,434 B2 * 7/2013 Funayama ..... H01R 12/716 439/637
8,672,713 B2 * 3/2014 Tajiri ..... H01R 12/585 439/630
9,160,105 B2 * 10/2015 Takaki ..... H01R 12/716
9,178,326 B2 * 11/2015 Funayama ..... H01R 12/91
9,287,654 B2 * 3/2016 Takaki ..... H01R 13/52
2002/0022381 A1 * 2/2002 Ito ..... H01R 12/721 439/60
2002/0098740 A1 * 7/2002 Ooya ..... G06K 7/0021 439/630
2006/0099856 A1 5/2006 Takei et al.
2009/0209142 A1 8/2009 Sasaoka et al.
2012/0142226 A1 6/2012 Funayama et al.

FOREIGN PATENT DOCUMENTS

JP 2006-134687 A 5/2006
JP 2009-199766 A 9/2009
JP 2009-230945 A 10/2009
JP 4374074 B1 12/2009
JP 4421766 B1 2/2010

* cited by examiner

CONTACT HAVING TWO CONTACT PORTIONS WITH THEIR CENTRAL LINES IN ONE PLANE

CROSS REFERENCE TO RELATED APPLICATIONS

This application claims priority of Japanese Patent Application No. 2014-160213 filed Aug. 6, 2014, Japanese Patent Application No. 2014-245440 filed Dec. 4, 2014, and Japanese Patent Application No. 2015-044202 filed Mar. 6, 2015, which are hereby incorporated by reference in their entirety.

BACKGROUND

Technical Field

The present disclosure relates to a contact employed in a connector used for industrial instruments, electrical devices or electronic devices, and, particularly, relates to a structure that can achieve downsizing in a longitudinal pitch direction and a lateral (width) direction of the connector with a simple structure, that is not damaged even if downsized and that can obtain a stable contact (connection) reliability.

Background

A contact is generally provided with at least a contact portion that comes into contact with a counterpart object and a connecting portion that connects to an object to be connected. Also, a securing portion for the retention in the insulating object may be provided as needed (depending on securing measures). The contact portion usually makes contact at a single location, and may also make contact at two locations to improve contact reliability. The connecting portion is connected to an object to be connected, e.g., a circuit board, a flexible printed circuit board (hereinafter, referred to as an FPC), a cable, etc., by soldering, pressure welding, pressure bonding or press fitting.

A connector is provided with at least the contact and the insulating object. A plurality of contacts are retained in the insulating object by press fitting, welding, or integral molding. The applicant has already proposed two-point contact in Japanese Laid-Open Patent Publication Nos. 2006-134687 and 2009-230945).

It is desirable to downsize a connector (downsizing in a longitudinal pitch direction and in a lateral (width) direction), and there is a need for a connector that is not problematic in its strength even if downsized and that has a stable contact (connection) reliability.

With the structure disclosed in Japanese Laid-Open Patent Publication No. 2006-134687, downsizing in a longitudinal pitch direction cannot be achieved, and with the structure of Japanese Laid-Open Patent Publication No. 2009-230945, downsizing in a lateral (width) direction cannot be achieved.

The present disclosure has been made in view of the above, and the present disclosure is related to providing a contact having a structure that can be downsized in the longitudinal pitch direction and the lateral (width) direction of the connector with a simple structure, and that is not damaged even if downsized, and that can achieve stable contact (connection) reliability.

SUMMARY

According to a first aspect of the present disclosure, a contact configured to be retained and arranged in an insulating object includes a contact portion that is configured to come into contact with a counterpart object, a connecting portion connectable to an object to be connected, a main body portion having two side walls and a joining wall that joins the side walls, the main body portion having a substantially U-shaped cross section, first and second contact pieces protruding from the two side walls and extending along a direction of mating with a counterpart object, and first and second contact portions disposed at free end parts of the first and second contact pieces, respectively, the first and second contact portions each having a curved shape and configured to come into contact with the same surface of the counterpart object, the first and second contact portions being spaced apart along the direction of mating, the first and second contact portions being configured to come into roll-face contact with the counterpart object.

It is preferable that at least one of the two side walls is provided with a securing portion with which the contact is capable of being retained in the insulating object.

Further, it is preferable that at least one of the two side walls is provided with a securing portion with which the contact is capable of being retained in the insulating object, the securing portion being disposed towards an upper contact portion side from the joining wall.

Preferably, the main body portion is formed by a close-contact bending.

It is preferable that the second contact piece is folded back from a tip thereof into a generally curved form and a tip of the first contact piece is folded in a generally L-shape, the tips of the first contact piece and the second contact piece being lapped with each other.

Preferably, the tips of the first contact piece and the second contact piece are lapped with each other and an effective mating length is ensured.

According to a second aspect of the present disclosure, a composite contact comprises two contacts of the first aspect formed in an integrated structure, the two contacts being arranged such that respective first contact portions face with each other and the respective second contact portions face with each other, the side walls from which the first contact pieces protrude being joined to each other by a joining portion or the side walls from which the second contact pieces protrude being joined to each other by a joining portion.

According to a third aspect of the present disclosure, a contact configured to be retained an arranged in an insulating object includes a contact portion that is configured to come into contact with a counterpart object, a connecting portion that is connectable to an object to be connected, a first contact piece protruding from a bottom wall in a direction of mating with the counterpart object and being folded back, and a second contact piece protruding from a side wall joined to the bottom wall in a direction of mating with the counterpart object, the first contact portion of the first contact piece and the second contact portion of the second contact piece being positioned to coincide with each other in a width direction of the contact.

It is preferable that the first contact portion of the first contact piece and the second contact portion of the second contact piece are positioned to coincide with each other in the width direction of the contact by folding the second contact portion with respect to the side wall of the first contact piece generally perpendicularly and bending the second contact portion.

It is also preferable that the first contact portion of the first contact piece and the second contact portion of the second contact piece are positioned to coincide with each other in the width direction of the contact by folding the side wall of the first contact piece obliquely.

According to a fourth aspect of the present disclosure, a connector includes one of the contact according to the first aspect of the present disclosure, the composite contact according to the second aspect of the present disclosure, and the contact according to the third aspect of the present disclosure, and an insulating object that retains and arranges one of the contact according to the first aspect of the present disclosure, the composite contact according to the second aspect of the present disclosure, and the contact according to the third aspect of the present disclosure.

According to the contact of the present disclosure, a connector can be downsized in a longitudinal pitch direction and a lateral (width) direction of the connector with a simple structure, and the connector is not damaged even if downsized and a stable contact (connection) reliability is obtained.

Further, with a connector including at least one contact of the present disclosure, a connector can be downsized in a longitudinal pitch direction and a lateral (width) direction of the connector, and the connector is not damaged even if downsized and a stable contact (connection) reliability is obtained.

With a structure in which at least one of the two side walls is provided with a securing portion with which the contact is capable of being retained in the insulating object, the securing portion being disposed towards an upper contact portion side from the joining wall, the insulating object can be used commonly for a single electric contact and a double electric contact, and there is no tipping of the joining wall portion, and thus a stable connection can be obtained.

With the structure in which the second contact piece is folded back from a tip thereof into a generally curved form and a tip of the first contact piece is folded in a generally L-shape, the tips of the first contact piece and the second contact piece being lapped with each other, or the structure in which the tips of the first contact piece and the second contact piece are lapped with each other and an effective mating length is ensured, a sufficient effective mating length (effective contact length), which is a distance from the beginning of contact to complete mating when mated with a counterpart object, can be ensured. By ensuring a sufficient effective mating length, even if mating is somewhat insufficient, it will not lead to poor connection. Further, the contact according to the second aspect of the present disclosure may be used for a large current.

DETAILED DESCRIPTION

Figure 1A:
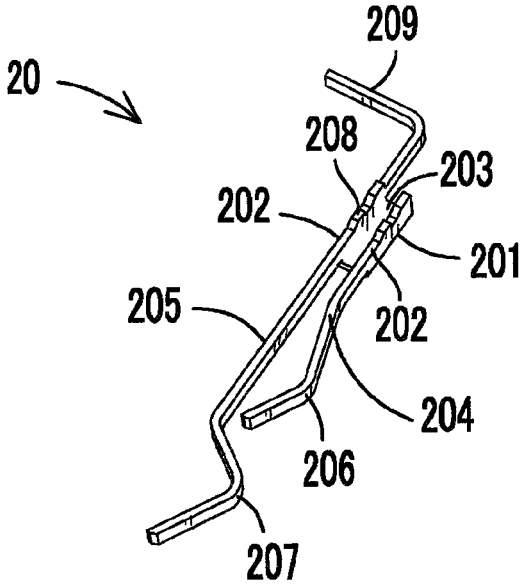
FIG. 1A is a perspective view of a contact according to a first embodiment of the present disclosure viewed obliquely from a mating-direction side from which a counterpart object is mated.

Further features of the present disclosure will become apparent from the following detailed description of exemplary embodiments with reference to the accompanying drawings.

The present disclosure is directed to a contact 20 to be retained and arranged in an insulating object 40, the contact 20 including a contact portion that is configured to come into contact with a counterpart object, a connecting portion 209 connectable to an object to be connected, a main body portion 201 having two side walls 202 and a joining wall 203 that joins the side walls 202, the main body portion 201 having a substantially U-shaped cross section, first and second contact pieces 204, 205 protruding from the two side walls 202, 202, respectively, and extending along a direction of mating with a counterpart object, and first and second contact portions 206, 207 disposed at free end parts of the first and second contact pieces 204, 205, respectively, the first and second contact portions 206, 207 each having a curved shape and configured to come into contact with the same surface of the counterpart object, the first and second contact portions 206, 207 being spaced apart along the direction of mating such that the second contact portion 207 first comes into contact with the counterpart object and subsequently the first contact portion 206 comes into contact with the counterpart object, the first and second contact portions 206, 207 being configured to come into roll-face contact with the counterpart object.

That is, the contact 20, 30 of the present disclosure includes two contact pieces 204, 205, 304, 305 respectively protruding into the direction of mating from the two side walls 202 of the main body portion 201, 301, which is square bent or formed by a close-contact bending, and contact portions 206, 207, 306, 307 provided at each free end side to be in roll-face contact with the same surface of the counterpart object one above the other.

An embodiment of a connector 10 of the present disclosure will be described with reference to FIG. 1A to FIG. 9C.

Figure 1B:
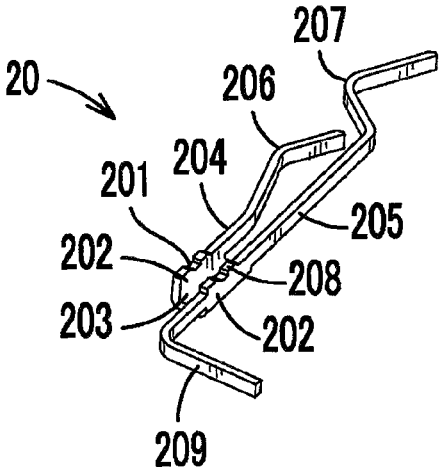
FIG. 1B is a perspective view of the contact according to the first embodiment of the present disclosure viewed obliquely from a connecting-direction side from which an object to be connected is connected.

FIG. 1A is a perspective view of a contact according to a first embodiment of the present disclosure viewed obliquely from a mating-direction side from which a counterpart object is mated; and FIG. 1B is a perspective view of the contact according to the first embodiment of the present disclosure viewed obliquely from a connecting-direction side from which an object to be connected is connected.

Figure 2A:
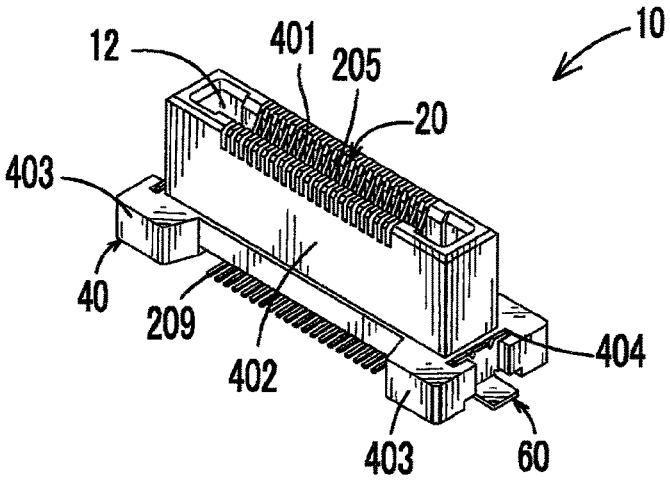
FIG. 2A is a perspective view of a connector having the contacts of the first embodiment of the present disclosure viewed obliquely from a mating-direction side from which a counterpart object is mated.
Figure 2B:
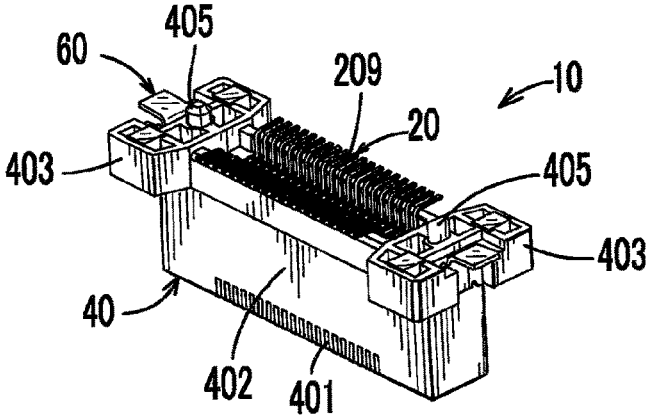
FIG. 2B is a perspective view of the connector having the contacts of the first embodiment of the present disclosure viewed obliquely from a connecting-direction side from which an object to be connected is connected.
Figure 2C:
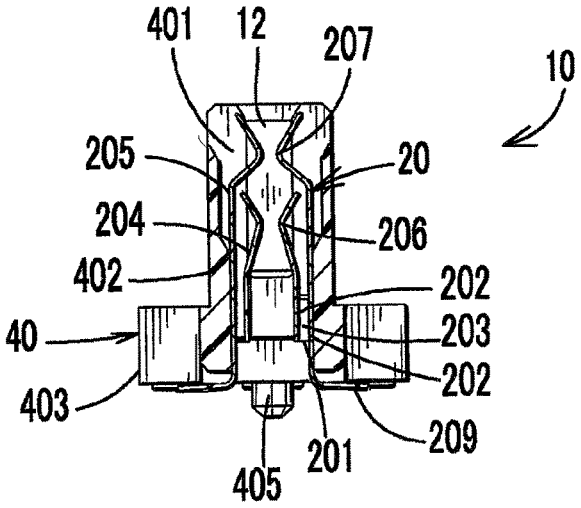
FIG. 2C is a cross sectional view of the connector having the contacts of the first embodiment of the present disclosure taken along a line through an insertion hole portion of the contact.

FIG. 2A is a perspective view of a connector having the contacts of the first embodiment of the present disclosure viewed obliquely from a mating-direction side from which a counterpart object is mated; FIG. 2B is a perspective view of the connector having the contacts of the first embodiment of the present disclosure viewed obliquely from a connecting-direction side from which an object to be connected is connected; and FIG. 2C is a cross sectional view of the connector having the contacts of the first embodiment of the present disclosure taken along a line through an insertion hole portion of the contact.

Figure 3A:
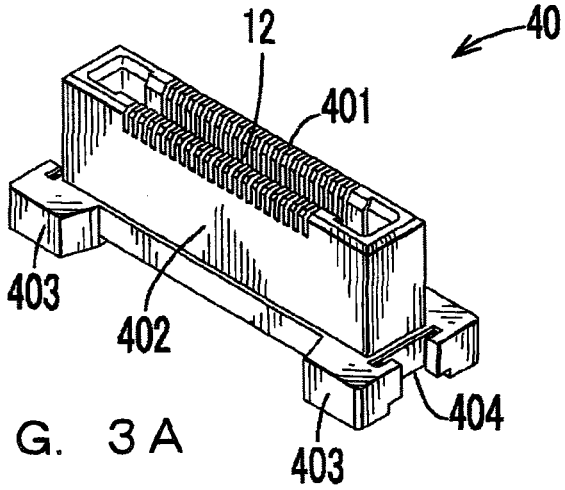
FIG. 3A is a perspective view of an insulating object viewed obliquely from a mating-direction side.
Figure 3B:
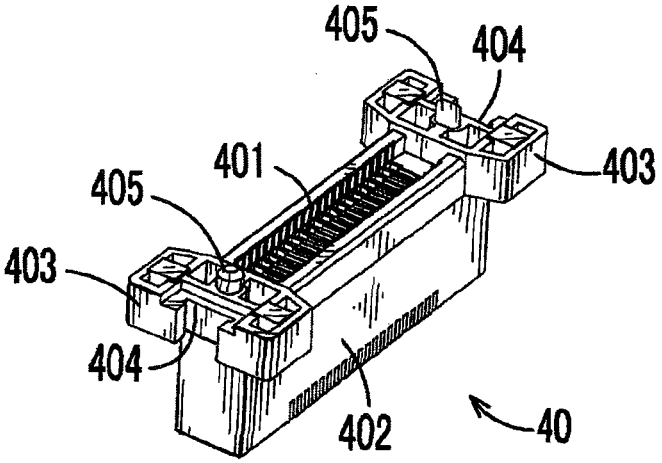
FIG. 3B is a perspective view of the insulating object viewed from a side opposite to the mating-direction side (connecting-direction side).
Figure 3C:
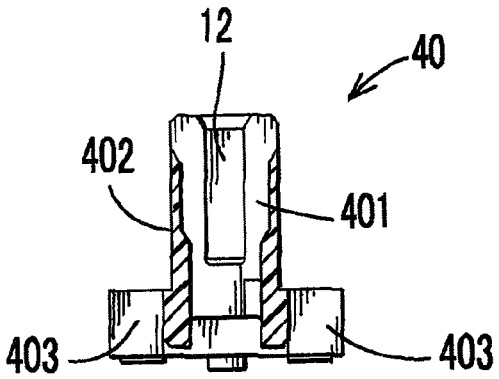
FIG. 3C is a cross sectional view of the insulating object taken along a line through an insertion hole portion of the contact.

FIG. 3A is a perspective view of an insulating object viewed obliquely from a mating-direction side; FIG. 3B is a perspective view of the insulating object viewed from a side opposite to the mating-direction side (connecting-direction side); and FIG. 3C is a cross sectional view of the insulating object taken along a line through an insertion hole portion of the contact.

Figure 4A:
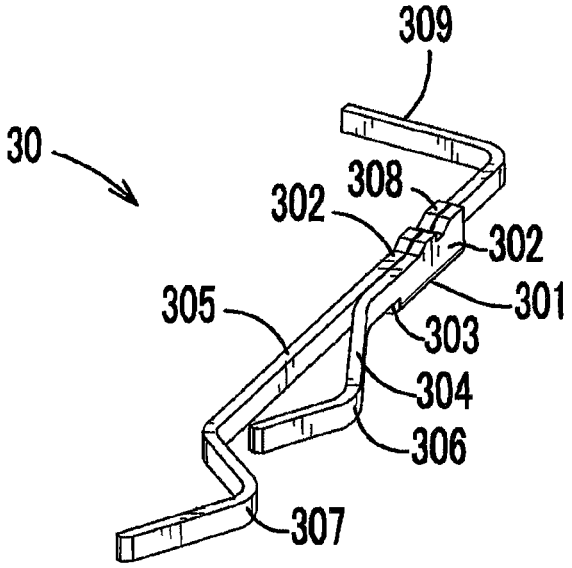
FIG. 4A is a perspective view of a contact according to a second embodiment of the present disclosure which is formed by a close-contact bending and viewed obliquely from a mating-direction side from which a counterpart object is mated.
Figure 4B:
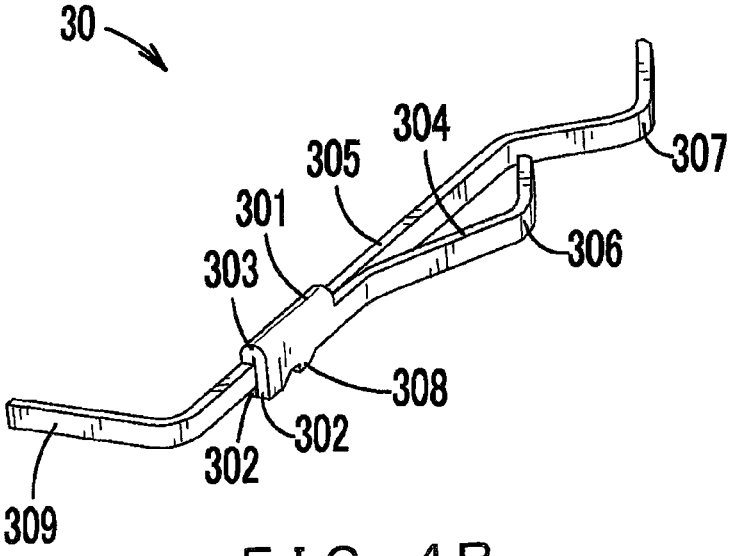
FIG. 4B is a perspective view of the contact according to the second embodiment of the present disclosure which is formed by a close-contact bending and viewed obliquely from a connecting-direction side from which an object to be connected is connected.

FIG. 4A is a perspective view of a contact according to a second embodiment of the present disclosure which is formed by a close-contact bending and viewed obliquely from a mating-direction side from which a counterpart object is mated; and FIG. 4B is a perspective view of the contact according to the second embodiment of the present disclosure which is formed by a close-contact bending and viewed obliquely from a connecting-direction side from which an object to be connected is connected.

Figure 5A:
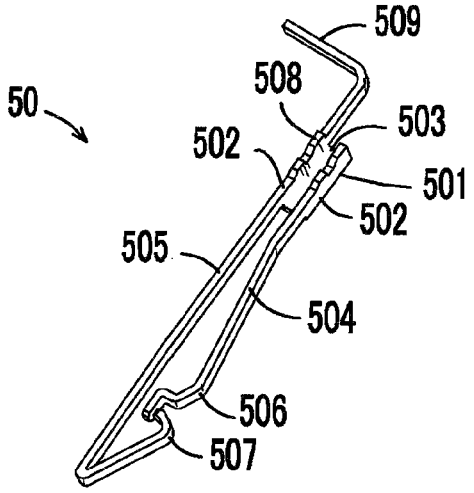
FIG. 5A is a perspective view of a contact according to a third embodiment of the present disclosure viewed obliquely from a mating-direction side from which a counterpart object is mated.
Figure 5B:
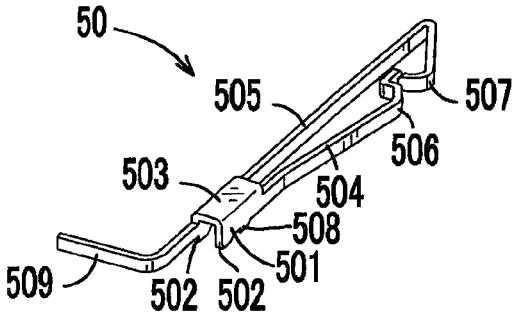
FIG. 5B is a perspective view of the contact according to the third embodiment of the present disclosure viewed obliquely from a connecting-direction side from which an object to be connected is connected.

FIG. 5A is a perspective view of a contact according to a third embodiment of the present disclosure viewed obliquely from a mating-direction side from which a counterpart object is mated; FIG. 5B is a perspective view of the contact according to the third embodiment of the present disclosure viewed obliquely from a connecting-direction side from which an object to be connected is connected; and FIG. 5C is a cross sectional view of a contact according to the third embodiment of the present disclosure taken along a line through an insertion hole portion of the contact.

Figure 5C:
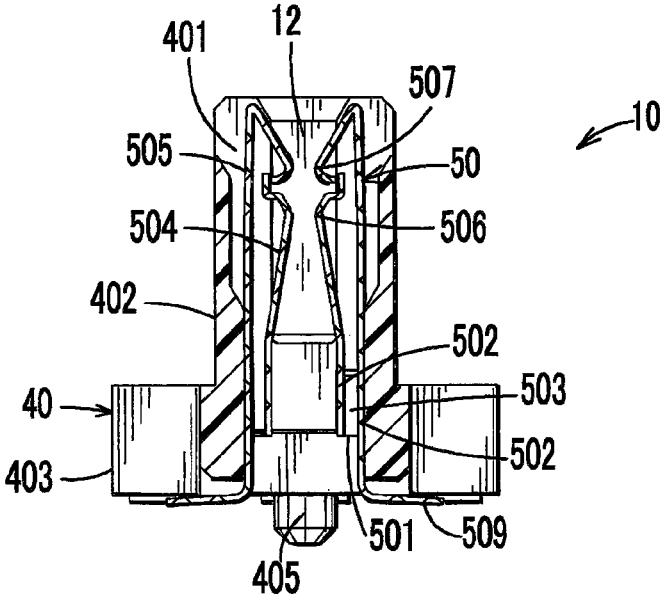
FIG. 5C is a cross sectional view of a contact according to the third embodiment of the present disclosure taken along a line through an insertion hole portion of the contact.
Figure 6A:
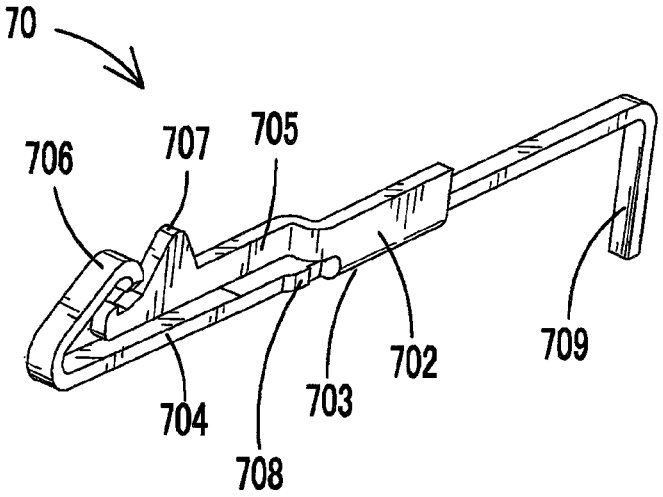
FIG. 6A is a perspective view of a contact according to a fourth embodiment of the present disclosure that is different from the third embodiment shown in FIGS. 5A to 5C viewed obliquely from a mating-direction side from which a counterpart object is mated.
Figure 6B:
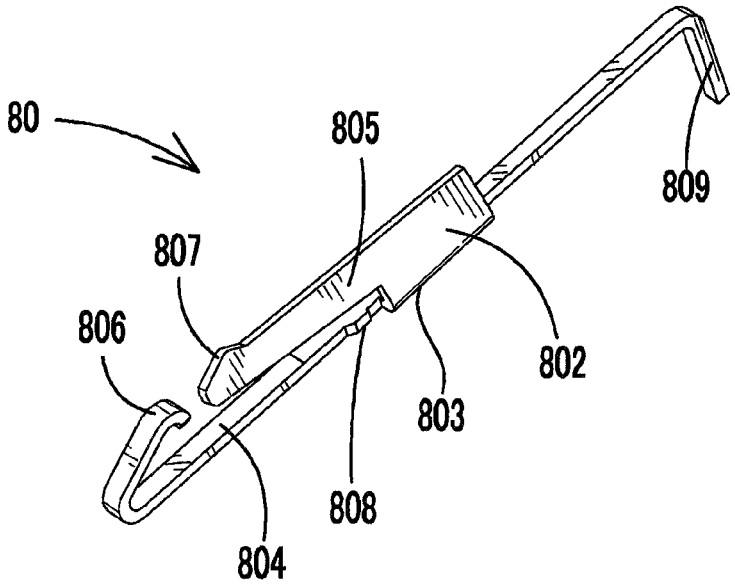
FIG. 6B is a perspective view of a contact according to the fifth embodiment of the present disclosure that is different from the third embodiment shown in FIGS. 5A to 5C viewed obliquely from a mating-direction side from which a counterpart object is mated.

FIG. 6A is a perspective view of a contact according to a fourth embodiment of the present disclosure that is different from the third embodiment shown in FIGS. 5A to 5C viewed obliquely from a mating-direction side from which a counterpart object is mated; and FIG. 6B is a perspective view of a contact according to the fifth embodiment of the present disclosure that is different from the third embodiment shown in FIGS. 5A to 5C viewed obliquely from a mating-direction side from which a counterpart object is mated.

Figure 7A:
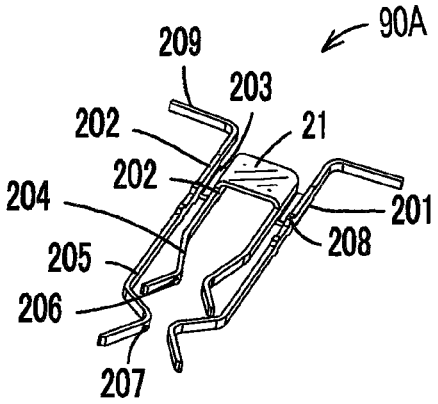
FIG. 7A is a perspective view of a composite contact including the contacts of the present disclosure shown in FIGS. 1A and 1B that are integrally joined by a joining portion and viewed obliquely from a mating-direction side from which a counterpart object is mated.
Figure 7B:
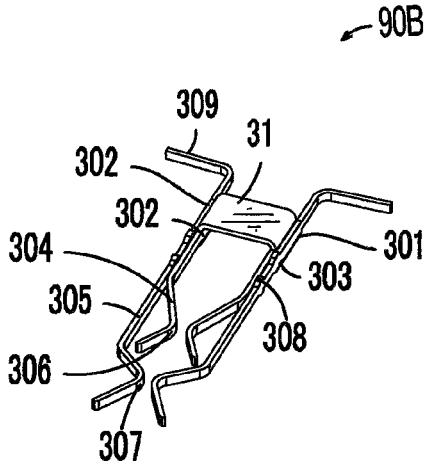
FIG. 7B is a perspective view of a composite contact including the contacts of the present disclosure shown in FIGS. 4A and 4B that are integrally joined by a joining portion and viewed obliquely from a mating-direction side from which a counterpart object is mated.
Figure 7C:
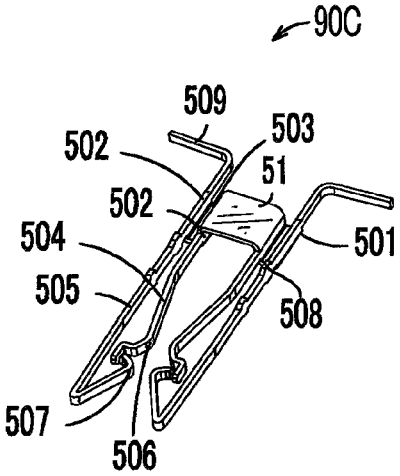
FIG. 7C is a perspective view of a composite contact including the contacts of the present disclosure shown in FIGS. 5A to 5C that are integrally joined by a joining portion and viewed obliquely from a mating-direction side from which a counterpart object is mated.
Figure 7D:
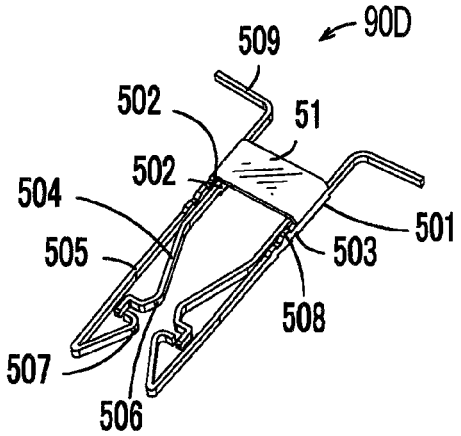
FIG. 7D is a perspective view of a composite contact including the contacts of the present disclosure shown in FIG. 5A to 5C that are integrally joined by a joining portion that joins side walls which are different from the side walls joined in FIG. 7A to 7C and viewed obliquely from a mating-direction from which a counterpart object is mated.

FIG. 7A is a perspective view of a composite contact including the contacts of the present disclosure shown in FIGS. 1A and 1B that are integrally joined by a joining portion and viewed obliquely from a mating-direction side from which a counterpart object is mated; FIG. 7B is a perspective view of a composite contact including the contacts of the present disclosure shown in FIGS. 4A and 4B that are integrally joined by a joining portion and viewed obliquely from a mating-direction side from which a counterpart object is mated; FIG. 7C is a perspective view of a composite contact including the contacts of the present disclosure shown in FIGS. 5A to 5C that are integrally joined by a joining portion and viewed obliquely from a mating-direction side from which a counterpart object is mated; and FIG. 7D is a perspective view of a composite contact including the contacts of the present disclosure shown in FIG. 5A to 5C that are integrally joined by a joining portion that joins side walls which are different from the side walls joined in FIG. 7A to 7C and viewed obliquely from a mating-direction from which a counterpart object is mated.

Figure 8A:
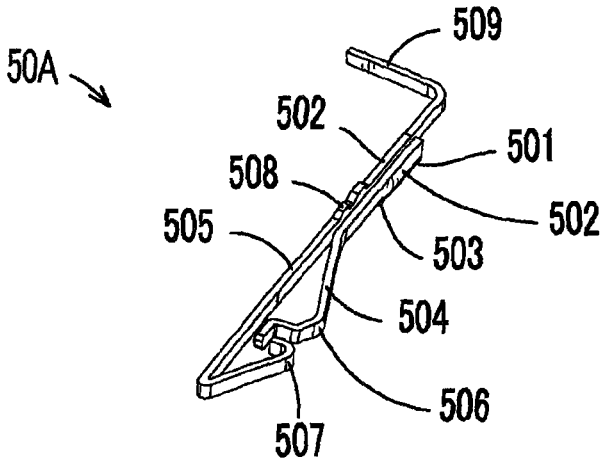
FIG. 8A is a perspective view of a contact according to a first variant of the third embodiment of the present disclosure in which a position of a securing portion has been changed and viewed obliquely from a mating-direction side of the counterpart object.
Figure 8B:
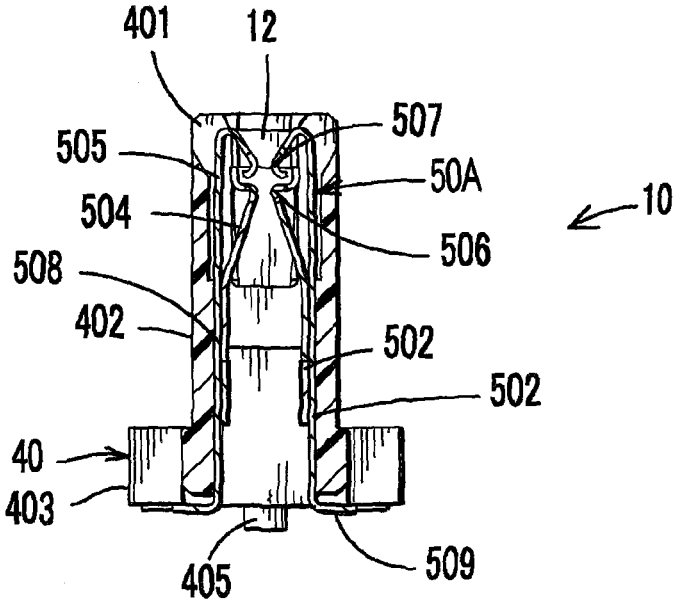
FIG. 8B is a cross sectional view of a connector having the contact shown in FIG. 8A taken along a line through an insertion hole portion of the contact.

FIG. 8A is a perspective view of a contact according to a first variant of the third embodiment of the present disclosure in which a position of a securing portion has been changed and viewed obliquely from a mating-direction side of the counterpart object; FIG. 8B is a cross sectional view of a connector having the contact shown in FIG. 8A taken along a line through an insertion hole portion of the contact.

Figure 9A:
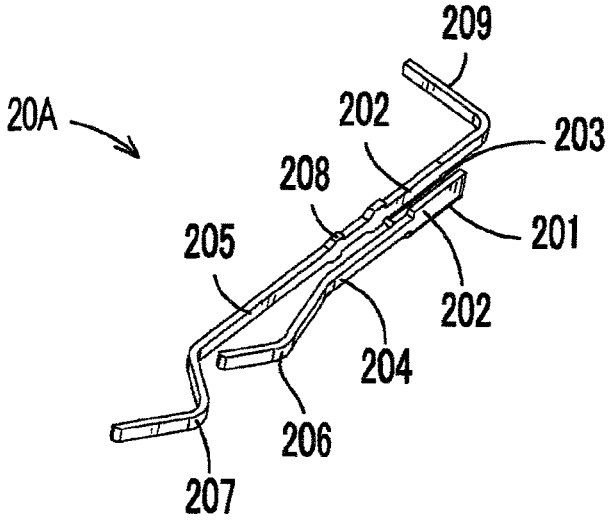
FIG. 9A is a perspective view of a contact according to a first variant of the first embodiment of the present disclosure in which a position of a securing portion has been changed and viewed obliquely from a mating-direction side from which a counterpart object is mated.
Figure 9B:
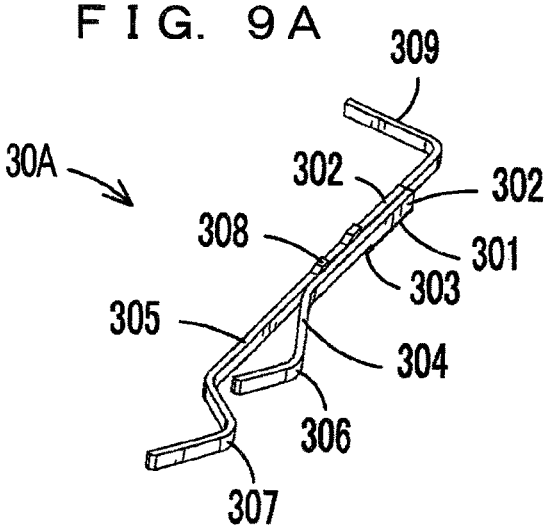
FIG. 9B is a perspective view of a contact according to a first variant of the second embodiment of the present disclosure in which a position of a securing portion has been changed and viewed obliquely from a mating-direction side from which a counterpart object is mated.
Figure 9C:
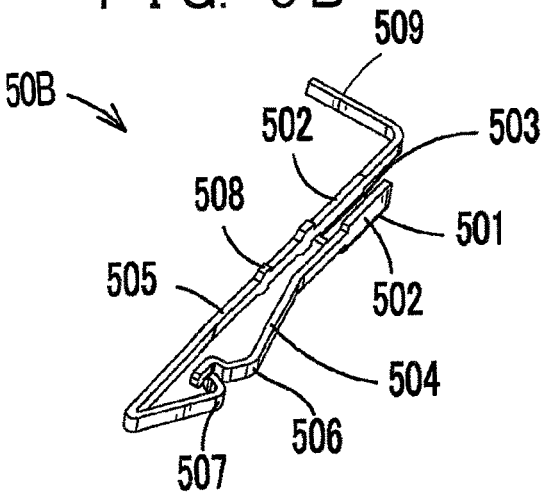
FIG. 9C is a perspective view of a contact according to a second variant of the third embodiment of the present disclosure in which a position of a securing portion has been changed and viewed obliquely from a mating-direction side from which a counterpart object is mated.

FIG. 9A is a perspective view of a contact according to a first variant of the first embodiment of the present disclosure in which a position of a securing portion has been changed and viewed obliquely from a mating-direction side from which a counterpart object is mated; FIG. 9B is a perspective view of a contact according to a first variant of the second embodiment of the present disclosure in which a position of a securing portion has been changed and viewed obliquely from a mating-direction side from which a counterpart object is mated; and FIG. 9C is a perspective view of a contact according to a second variant of the third embodiment of the present disclosure in which a position of a securing portion has been changed and viewed obliquely from a mating-direction side from which a counterpart object is mated.

Before explaining the connector 10, the counterpart object and the object to be connected will be described. The counterpart object may include, but is not limited to, a connector, a circuit board and a flexible printed circuit board (hereinafter referred to as an FPC). In the present embodiment, the counterpart object is a connector. The object to be connected may include, but is not limited to, a circuit board, a FPC and a cable. In the present embodiment, the object to be connected is a circuit board, and the circuit board is provided with a land on which a contact 20, 30 of the connector 10 is mounted and a pattern that extends from the land and connected to an electronic component or the like.

Referring to FIG. 1A to FIG. 9C, the connector 10 having the contacts 20, 30, 50, 70, 80 of the present disclosure will be described. The connector 10 includes at least one contact 20, 30, 50, 70, 80 having at least a contact portion that comes into contact with a counterpart object and a connecting portion 209, 309, 509, 709, 809 to be mounted on a circuit board, and an insulating object 40 in which the at least one contact 20, 30, 50, 70, 80 are retained and arranged.

First, the contact 20 which is essential to the present disclosure will be described. The contact 20 is made of metal, and manufactured by press working or machining as known in the art. Since the contact 20 needs to be made of a material having a spring property, conductivity and dimensional stability, the material may include, but is not limited to, brass, beryllium copper and phosphor bronze. In the present embodiment, the contact 20 is secured to the insulating object 40 by press fitting, but it is not limited thereto, as long as it can be secured, and may include methods such as locking (lance), welding or integral molding.

The contact 20 has at least the contact portions 206, 207 that are configured to come into contact with the counterpart object and the connecting portion 209 that is to be mounted on a circuit board, and further has a securing portion 208 that is to be secured to the insulating object 40.

The contact 20 is provided with a main body portion 201 having a substantially U-shape formed by square bending, and the main body portion 201 includes two side walls 202 and 202 and a joining wall 203 that joins the side walls 202 and 202.

Two contact pieces, namely, a first contact piece 204 and a second contact piece 205, are provided that protrude from the two side walls 202 and 202, respectively, in the direction of mating. The first and second contact pieces 204 and 205 are provided with, at a free end part thereof, a first contact portion 206 and a second contact portion 207, respectively, that are configured to come into contact with a counterpart object. The first and second contact portions 206 and 207 are spaced apart along the direction of mating so as to be in roll-face contact with the same face of the counterpart object at an upper position and a lower position on the face of the counterpart object.

The first and second contact pieces 204 and 205 are appropriately designed to have a shape and a size to easily come into contact with the counterpart object by taking into consideration factors such as a contact force, downsizing of the connector, a strength, and an elastic force. The first and second contact pieces 204 and 205 are disposed one above the other.

The first contact portion 206 and the second contact portion 207 are portions that come into contact with the counterpart object and curved for easy contact. Roll-face contact can be provided one above another in such a manner that the first contact portion 206 is at an upper part of counterpart object (a direction of mating side) and the second contact portion 207 is at a lower part of the counterpart object (opposite side of the direction of mating). The first contact portion 206 and the second contact portion 207 are appropriately designed to have a shape and a size taking into consideration factors such as the follow of the counterpart object, a contact stability, downsizing of the connector, a strength and workability.

The connecting portion 209 is a portion to be mounted on the circuit board. A method of connecting to the circuit board includes, but not limited to, soldering (surface mounting and dipping), pressure welding, pressure bonding, and press fitting. In the present embodiment, the contact 20 is of a circuit board mounting type, and mounted by soldering.

The securing portion 208 may be configured to enable any method as long as securing to the insulating object 40 is possible, and includes, but not limited to, press fitting, locking (lance), welding or integral molding. In accordance with the present embodiment, retaining and securing is performed by press fitting to the insulating object 40. In the present embodiment, the securing portion 208 is provided on a free end side of the two side wall 202 portions. The securing portion 208 is appropriately designed to have a shape and a size by taking into consideration factors such as a retaining force, workability and a strength. The securing portion 208 is provided with an arrowhead-shaped projection on the side wall 202 and secured by press fitting to the insulating object 40. In the present embodiment, it is square bent into a size of about 0.1 mm to 0.3 mm.

The insulating object 40 will now be described. The insulating object 40 is made of an electrically insulating plastic, and is manufactured by injection molding or cutting as known in the art. The material is appropriately selected by taking into consideration factors such as dimensional stability, workability and cost, and generally includes, but is not limited to, polybutylene terephthalate (PBT), polyamide (66PA, 46PA), a liquid crystalline polymer (LCP), polycarbonate (PC) and compound materials thereof. In accordance with the present embodiment, the insulating object 40 is manufactured by injection molding.

The insulating object 40 has a generally boxed shape. According to the present embodiment, the insulating object 40 includes a main body 402 and flanges 403 on either ends of the insulating object 40 in a longitudinal pitch direction. Further, the main body 402 of the insulating object 40 is provided with a plurality of insertion holes 401 with which the at least one contact 20 is retained and arranged. The contact 20 is secured to the insertion hole 401 by press fitting, locking (lance), welding and integral molding. A plurality of contacts 20 may be arrayed in the insulating object 40. In the present embodiment, the contact 20 is secured by press fitting. The insertion hole 401 may be of any shape and size as long as the contact 20 can be retained, and appropriately designed by taking into consideration the factors such as strength, workability and downsizing.

The main body 402 is provided with an engaging opening 12 in which the counterpart object is inserted. The engaging opening 12 has any shape and size as long as it can mate with the counterpart object, but it is designed as appropriate while taking into consideration factors such as strength and workability in accordance with the shape and size of the counterpart object.

In the present embodiment, in order to provide stronger connection with the object be connected, the flange 403 is provided with an attaching opening 404 where to a securing bracket 60 is attached. The attaching opening 404 is designed such that the securing bracket 60 can be attached thereto, and appropriately designed by taking into consideration factors such as a retaining strength, a retaining force, workability and a strength.

In the present embodiment, the flange 403 is provided with, on a connection side thereof to the object to be connected, a misinsertion prevention pin 405 for preventing false connection to the object to be connected. The misinsertion prevention pin 405 is appropriately designed to have a shape and a size to prevent misinsertion by taking into consideration factors such as a function, a strength and workability. In the present embodiment, the two ends are designed to have different shapes to prevent misinsertion.

The securing bracket 60 will now be described. The securing bracket 60 is made of metal, and manufactured by press working or machining as known in the art. Since the securing bracket 60 needs to be made of a material having a spring property, conductivity and dimensional stability, the material may include, but is not limited to, brass, beryllium copper and phosphor bronze. In the present embodiment, the securing bracket 60 is secured to an attaching opening 404 of the flange 403 of the insulating object 40 by a press fitting, but it is not limited thereto, as long as it can be secured, and may include locking (lance), welding or integral molding.

The contact 30 shown in FIGS. 4A and 4B will now be described. Here, only the difference between the contact 30 and the contact 20 will be described. The difference with respect to the contact 20 resides in how the main body portions 201 and 301 are formed. The contact 30 is formed by a close-contact bending for further downsizing in a longitudinal pitch direction as compared to the contact 20, which is square bent. The main body portion 301 has a size of twice the thickness of the metal sheet.

Next, referring to FIGS. 5A to 5C, the contact 50 will be described. Here, only the difference between the contact 50 and the contact 20 will be described. The difference with respect to the contact 20 is that the second contact piece 505 is folded back from a tip thereof into a generally curved form and a tip of the first contact piece 504 is folded in a generally L-shape, and the tips of the first contact piece 504 and the second contact piece 505 are lapped with each other. In this manner, a sufficient effective mating length can be ensured and also a guide for the counterpart object is provided. It is to be noted that the tips of the first contact piece 504 and the second contact piece 505 are designed not to come into contact when completely mated with the counterpart object.

In this manner, with the tips of the first contact piece 504 and the second contact piece 505 being disposed to lap with each other, a sufficient effective mating length (effective contact length), which is a distance from the beginning of contact to complete mating when mated with a counterpart object, can be ensured. A sufficient effective mating length can be ensured by suppressing a gap between the first contact portion 506 and the second contact portion 507 to around 0.3 mm to 0.6 mm.

The contacts shown in FIGS. 1A, 1B, 4A, 4B, 5A, 5B and 5C which have combined structures joined by joining portions 21, 31 and 51, respectively, will be described with reference to FIGS. 7A to 7D. Contacts 90A to 90D shown in FIGS. 7A to 7D include two contacts 20, 30 or 50 shown in FIGS. 1A, 1B, 4A, 4B, 5A, 5B and 5C that are arranged such that the respective first contact portions 206, 306, 506 face with each other and the respective second contact portions 207, 307, 507 of the contacts 20, 30, 50 face with each other. The side walls 202, 302, 502 from which the first contact pieces 204, 304, 504 extend are joined with each other by a joining portion 21, 31, 51 or the side walls 202, 302, 502 from which the second contact piece 205, 305, 505 extend are joined with each other by a joining portion 21, 31, 51. The joining portion 21, 31, 51 is designed to have an appropriate shape and size by taking into consideration factors such as downsizing of the connector, shape and size of the counterpart object, purpose of use, strength, and workability.

Referring now to FIG. 6A, the contact 70 will be described. Here, only the difference between the contact 70 and the contact 20 will be described. The difference with respect to the contact 20 is that a first contact piece 704 is provided that protrudes from a bottom wall 703 corresponding to a joining portion 203 towards a direction of mating with the counterpart object and folded back, and a second contact piece 705 is provided that protrudes from a side wall 702 joined with the bottom wall 703 towards a direction of mating with the counterpart object, the first contact portion 706 of the first contact piece 704 and the second contact portion 707 of the second contact piece 705 being positioned to coincide with each other in a width direction of the contact 70. In order to provide the first contact portion 706 of the first contact piece 704 and the second contact portion 707 of the second contact piece 705 to coincide with each other in a width direction of the contact 70, the side wall of the first contact piece is folded generally perpendicularly with respect to the second contact portion 707 and the second contact portion is bent.

Referring now to FIG. 6B, the contact 80 will be described. Here, only the difference between the contact 80 and the contact 20 will be described. The difference with respect to the contact 20 is that a first contact piece 804 is provided that protrudes from a bottom wall 803 corresponding to a joining portion 203 towards a direction of mating with the counterpart object and folded back, and a second contact piece 805 is provided that protrudes from a side wall 802 joined with the bottom wall 803 towards a direction of mating with the counterpart object, the first contact portion 806 of the first contact piece 804 and the second contact portion 807 of the second contact piece 805 being positioned to coincide with each other in a width direction of the contact 80. In order to provide the first contact portion 806 of the first contact piece 804 and the second contact portion 807 of the second contact piece 805 to coincide with each other in a width direction of the contact 80, the side wall 802 of the first contact piece 804 is folded obliquely.

Referring to FIGS. 8A, 8B, 9A, 9B and 9C, contacts 20A, 30A, 50A and 50B will be described in which the position of the securing portion 208, 308, 508 has been changed. These contacts 20A, 30A, 50A and 50B are similar to those described above except that the position of the securing portion 208, 308, 508 has been changed. In order to avoid tipping of the contact 20, 30, 50 upon insertion of the contacts 20, 30, 50 into the insulating object 40, at least one of the first contact piece 204, 304, 504 and the second contact piece 205, 305, 505 is provided with the securing portion 208, 308, 508 located at a position towards a contact portion side from the joining wall 203, 303, 503. That is, the joining wall 203, 303, 503 that is formed-by a close contact bending or substantially U-shaped and the side walls 202, 302, 502 are configured to protrude to the circuit board side through an insertion hole 401 of the insulating object 40. Further, by providing the securing portion 208, 308, 508 at such a position, the insulating object 40 can be used commonly for a single electric contact and a double electric contact.

The present disclosure is applicable to a contact used in a connector that is used for an industrial instrument, an electrical devices or electronic devices, and, particularly, relates to a structure that can achieve downsizing in a longitudinal pitch direction and a lateral (width) direction of the connector, that is not damaged even if downsized, a stable contact (connection) reliability is obtained.

What is claimed is:

1. A contact configured to be retained and arranged in an insertion hole extending in a substantially straight line and formed to an insulating object, the contact comprising:

a main body portion having a bottom wall joined to a side wall;

a first contact piece protruding from the bottom wall of the main body portion in a direction of mating with a counterpart object and being folded back in a direction opposite to the direction of mating;

a second contact piece protruding from the side wall of the main body portion in the direction of mating;

a connecting portion protruding from the bottom wall of the main body portion in the direction opposite to the direction of mating and that is connectable to an object to be connected;

wherein a central line of a first contact portion of the first contact piece and a central line of a second contact portion of the second contact piece are positioned in an imaginary plane, and wherein the connecting portion is folded in a direction generally perpendicular to the bottom wall.

2. The contact according to claim 1, wherein the central line of the first contact portion of the first contact piece and the central line of the second contact portion of the second contact piece are positioned in the imaginary plane by folding the side wall of the main body portion with respect to the bottom wall of the main body portion generally perpendicularly and bending the second contact piece.

3. The contact according to claim 1, wherein the central line of the first contact portion of the first contact piece and the central line of the second contact portion of the second contact piece are positioned in the imaginary plane by folding the side wall of the main body portion obliquely and bending the second contact piece.

4. A connector comprising:

a contact configured to be retained and arranged in an insertion hole extending in a substantially straight line and formed to an insulating object, the contact comprising:

a main body portion having a bottom wall joined to a side wall;

a first contact piece protruding from the bottom wall of the main body portion in a direction of mating with a counterpart object and being folded back in a direction opposite to the direction of the mating;

a second contact piece protruding from the side wall of the main body portion in a direction of mating;

a connecting portion protruding from the bottom wall of the main body portion in the direction opposite to the direction of mating and that is connectable to an object to be connected;

wherein a central line of a first contact portion of the first contact piece and a central line of a second contact portion of the second contact piece are positioned in an imaginary plane, and wherein the connecting portion is folded in a direction generally perpendicular to the bottom wall.

* * * * *